United States Patent [19]

Bergner et al.

[11] 4,420,387

[45] Dec. 13, 1983

[54] ELECTROLYSIS APPARATUS

[75] Inventors: Dieter Bergner; Kurt Hannesen, both of Kelkheim; Wilfried Schulte, Hofheim am Taunus; Peter Steinmetz, Kelkheim, all of Fed. Rep. of Germany

[73] Assignee: Hoechst Aktiengesellschaft, Frankfurt am Main, Fed. Rep. of Germany

[21] Appl. No.: 129,179

[22] Filed: Mar. 10, 1980

[30] Foreign Application Priority Data

Mar. 12, 1979 [DE] Fed. Rep. of Germany ..... 2909640

[51] Int. Cl.[3] ..... C25B 9/00; C25B 11/06; C25B 11/10; C25B 13/08

[52] U.S. Cl. ..... 204/263; 204/290 F; 204/292; 204/293; 204/296; 204/128

[58] Field of Search ..... 204/252–258, 204/263–266, 128, 286, 292–293, 296

[56] References Cited

U.S. PATENT DOCUMENTS

| | | | |
|---|---|---|---|
| 1,464,689 | 8/1923 | Allan | 204/254 |
| 4,017,375 | 4/1977 | Pohto | 204/255 |
| 4,029,565 | 6/1977 | Bender et al. | 204/256 |
| 4,056,458 | 11/1977 | Pohto et al. | 204/257 X |
| 4,108,752 | 8/1978 | Pohto et al. | 204/256 |
| 4,115,236 | 9/1978 | Smura | 204/255 X |
| 4,137,144 | 1/1979 | Kenney | 204/286 X |
| 4,196,068 | 4/1980 | Scoville | 204/255 |

*Primary Examiner*—Donald R. Valentine
*Attorney, Agent, or Firm*—Curtis, Morris & Safford

[57] ABSTRACT

The electrolysis apparatus for the manufacture of chlorine from aqueous alkali metal halide solutions has at least one electrolysis cell the electrodes of which, separated by a separating wall, are arranged in a housing of two hemispherical shells. The housing is furthermore provided with equipment for the feed of the starting materials for electrolysis, and equipment for the discharge of the electrolysis products. The separating wall is clamped by means of sealing elements between the rims of the hemispherical shells and positioned between power transmission elements of non-conductive material. The electrodes are fastened via spacers to the inner walls of the shells and connected mechanically and electrically with the shells via the rims thereof.

9 Claims, 8 Drawing Figures

FIG. 3
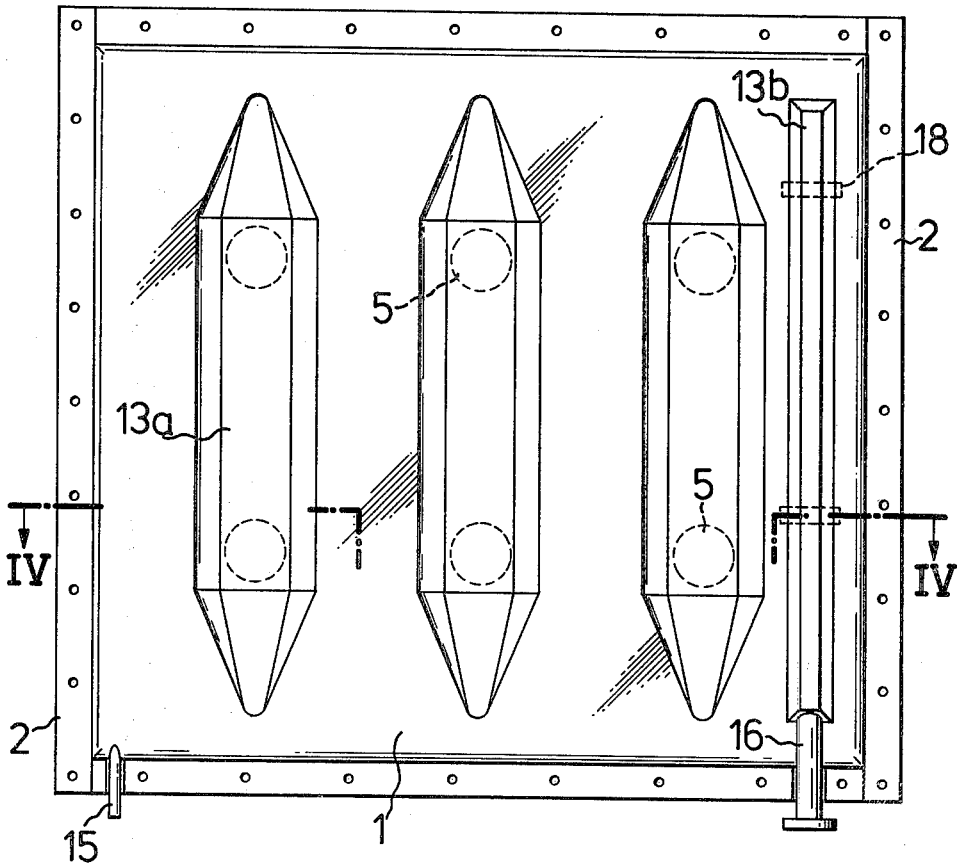
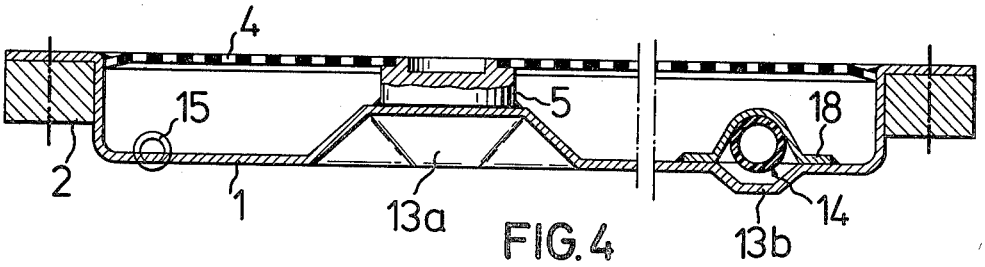
FIG. 4

ELECTROLYSIS APPARATUS

Subject of the invention is an electrolysis apparatus for the manufacture of chlorine from an aqueous alkali metal halide solution, wherein the anode and cathode spaces are separated from each other by a separating wall, for example a diaphragm or an ion exchange membrane.

In German Offenlegungsschrift No. 2,538,414, an electrolysis apparatus is described which, although being operational having one individual cell, is preferably applied in a corresponding device in the form of a multiple electrolysis cell. One element of this electrolysis apparatus comprises a housing consisting of two hemispherical shells to which the electrodes are connected by conductive bolts projecting through the wall of the shells; the projecting end faces of the bolts being provided with current supply means for clamping together the supply means, the shells, the electrodes and the separating wall, which wall is positioned between electrically insulating spacers mounted in the extension of the bolts on the electrolytically active side of the electrodes and clamped between the edges of the hemispherical shells by packing elements.

The housings of the known multiple electrolysis cells are provided with openings through which the current supply means are passed to be connected with the electrodes. This is a disadvantage, because leakages may occur at these openings which cannot be repaired but by stopping the operations of the complete electrolysis apparatus and replacing the leaking elements.

A further disadvantage resides in the fact that elements manufactured from thin steel or titanium sheets because of economic considerations become dented due to the hydrostatic pressure of the liquid column in the cell, and therefore cannot be removed from the clamping device but with difficulty when they are filled wth liquid.

Still another disadvantage of the known multiple electrolysis cells resides in the fact that considerable current leakages may occur via the feed ducts for the electrolyte solution and the discharge ducts for the product, which may cause corrosion damages on the metal parts of the cell.

It is therefore one object of the invention to provide an electrolysis apparatus which is not affected with the above disadvantages. A further object of the invention is to assemble the electrolysis apparatus by means of the individual cells in such a manner that the tightness of these individual cells, the state of the electric contacts and the current distribution can be easily supervised. Another object is to provide individual cells which are operational per se. Still another object is to ensure that defective cells filled with liquid can be easily removed or replaced for repair without requiring the complete electrolysis apparatus to be disassembled and the operations thus to be interrupted for a prolonged period.

In accordance with the invention, these objects are achieved by an electrolysis apparatus for the manufacture of chlorine from an aqueous alkali metal halide solution comprising at least one electrolytic cell the anode and cathode of which, separated by a separating wall, are arranged in a housing of two hemispherical shells; the housing being provided with equipment for the feed of the starting materials for electrolysis and the discharge of the elecrolysis products, and the separating wall being clamped by means of sealing elements between the rims of the hemispherical shells and positioned between power transmission elements of non-conductive material extending each to the electrodes; wherein the electrodes are connected mechanically and electrically (conductively) with the hemispherical shells via the rim and via spacers fixed to the inner face thereof.

The hemispherical shells of the electrolysis cells may be provided with stiffenings, and at least one of the hemispherical shells of an electrolysis cell may be provided on its outer face with conductive power transmission elements in extension of the power transmission elements and spacers. In order to prevent current leakages, at least one vertically positioned tube of non-conductive material penetrating near the rim into the interior of the shells may be arranged therein for feeding the starting materials and/or discharging the electrolysis products.

The cathodes can be made of iron, cobalt, nickel, or chromium, or one of their alloys and the anodes consist of titanium, niobium, or tantalum, or an alloy of these metals, or of a metal-ceramic or oxide-ceramic material. The anodes are covered with an electrically conductive and catalytically active layer containing metals or compounds of the platinum group. Due to the shape of the electrodes, which consist of a perforated material, such as perforated plate, metal mesh, braided material, or constructions composed of thin bars of circular cross section and their arrangement in the electrolysis cell, the gases generated in the electrolysis can readily enter the space behind the electrodes. By this gas removal from the electrode gap the resistance generated by the gas bubbles between the electrodes is reduced and, hence, the cell voltage is diminished.

The hemispherical shells of the cathode side can be made of iron or iron alloys. In the case where the cathode and the corresponding hemispherical shell are to be welded with each other, they are suitably of the same material, preferably steel. The shell on the side of the anode must be made of a material resistant to chlorine such as titanium, niobium or tantalum, or an alloy of these metals, or a metal-ceramic or oxide-ceramic material. When the shell and the anode are to be connected with each other by welding, the same material for both pieces is chosen also in this case, preferably titanium. Alternatively, the hemispherical shells and the electrodes may be fastened to each other by screwing, and in this case, shells and electrodes may consist of different material.

As separating wall diaphragms or ion exchange membranes commonly used in alkali metal chloride electrolysis are suitable. The ion exchange membranes consist substantially of a copolymer of tetrafluoroethylene and perfluorovinyl compounds such as $CF_2{=}CF_2{-}O{-}CF_2{-}CF(CF_3){-}O{-}CF_2{-}CF_2{-}SO_3H$ or $CF_2{=}CF_2{-}O{-}CF_2{-}CF(CF_3){-}O{-}CF_2{-}CF_2{-}COOH$.

Likewise, membranes having terminal sulfonamide groups ($-SO_3NHR$) are used. The equivalent weight of such ion exchange membranes are in the range of from 800 to 1.600, preferably 1.100 to 1.500. For increasing the mechanical strength, the ion exchange membrane is generally reinforced by a supporting fabric of polytetrafluoroethylene.

Like the asbestos diaphragms the aforesaid ion exchange membranes prevent the hydrogen from mixing with chlorine, but, owing to their selective permeability, they permit the passage of alkali metal ions into the cathode compartment, i.e. they substantially prevent the halide from passing into the cathode compartment and the passage of hydroxyl ions into the anode compartment. Hence, the hydroxide solution obtained is practically free from alkali metal chloride, while on the other hand, the alkali metal chloride must be removed from the catholyte of the diaphrahm cells by a complicated process. Apart from this and in contradistinction to asbestos diaphragms, ion exchange membranes are dimensionally stable separating walls which are more resistant towards the corrosive media of the alkali metal halide electrolysis, and therefore, they have a longer service life than asbestos diaphragms.

The electrolytic apparatus according to the invention may consist of one electrolytic cell or of a plurality of series-connected cells, in which case the electric contact of adjacent cells in ensured directly by the hemispherical shells of adjacent electrolysis cells contacting each other, or by the conductive power transmission elements.

The electrolysis apparatus of the invention will now be described in further detail and by way of example with reference to the accompanying drawings in which FIG. 1 is a cross sectional view of an electrolysis cell and FIG. 2 a cross-sectional view of two adjacent electrolysis cells;

FIG. 3 represents a projection of a hemispherical shell;

FIG. 4 shows section IV—IV of FIG. 3;

Figure 1:
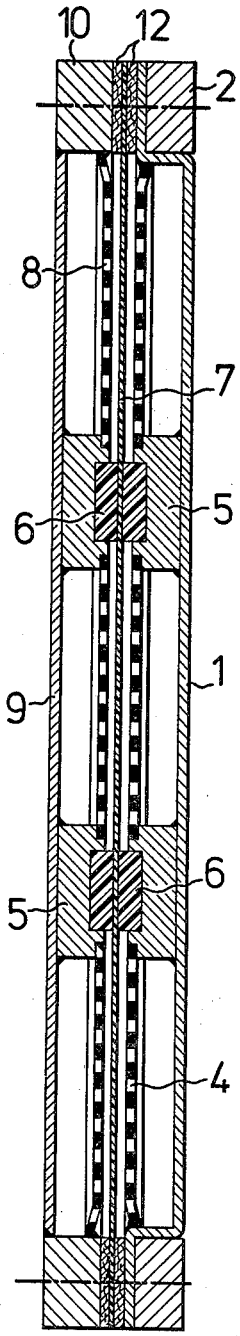

The housing of an electrolysis cell is composed of one hemispherical shell on the side of the anode and another on the side of the cathode. Shell 1 on the side of the anode is made of sheet-metal and provided with a loose flange 2, while the shell on the side of the cathode consists of a wall 9 connected with a fixed flange 10. Of course, alternatively, the shell on the side of the anode may be provided with a fixed flange and that on the side of the cathode may have a loose flange. The separating wall 7 is clamped between the sealing elements 12 facing the rims of the shells. The electrodes 4 and 8 are rigidly connected with the shells 1 and 9 by means of the spacers (for example bolts) 5. The electrolysis current is fed to the anode and cathode either directly by contact with the wall of the shell of the adjacent electrolysis cell, or by a power transmission element (for example bolt) 3, which is fastened to shell 1 for example by screws 11. The disks 6 serve as power transmission element and are electrically non-conductive. By chosing a corresponding thickness of the disks, the distance between the electrodes and that between the electrodes and the separating wall can be adjusted as intended. The hemispherical shells are stiffened by means of stiffening beads 13*a*.

Two embodiments of these stiffenings 13*a* and 13*b* are illustrated in FIGS. 2, 3, 4 and 6. Identical or other stiffenings are applied to the hemispherical shell on the side of the cathode, too.

FIG. 4 shows furthermore a discharge tube 14 for the electrolyte solutions together with a stiffening bead 13*b*; the tube 14 being kept in place by strap 18.

Figure 5:
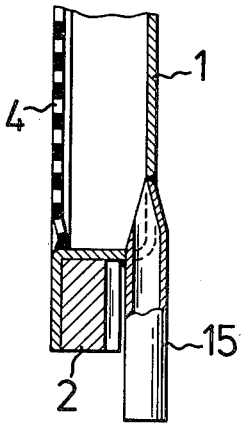
FIGS. 5 and 6 represent alternative embodiments of feed and discharge of gases and liquids to and from the electrolysis cell.

FIG. 5 illustrates the feed of the electrolyte to the cell via feed tube 15 which is rigidly connected with the hemispherical shell. This arrangement is likewise valid for shell 9 having a fixed flange.

Figure 6:
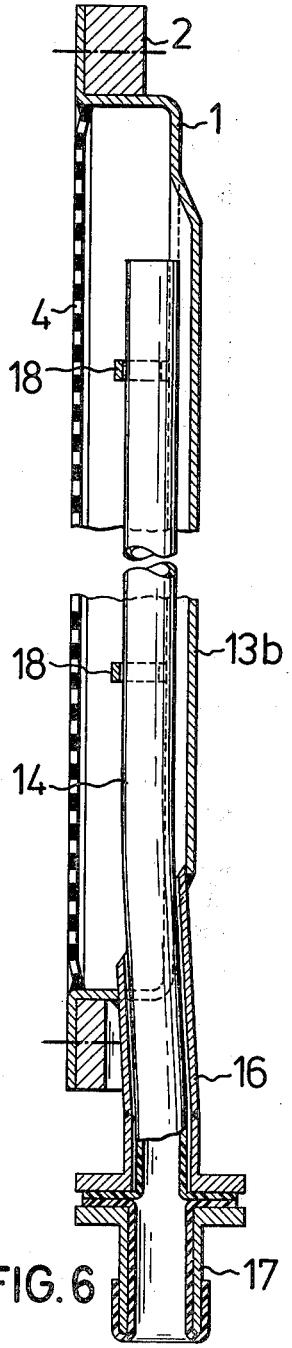

FIG. 6 demonstrates the discharge of the electrolyte. The long tube 14 made from insulating material carries off the electrolyte solution and the electrolysis gases from the cell and reduces leakages due to the length of that part of the tube which is situtated in the cell. It is introduced into the cell by means of the socket 16. The transition piece 17 ensures the connection with a hose duct (not shown). Of course, a tube connection in the form as shown in FIG. 6 can be applied likewise for the feed of the electrolytes.

Figure 2:
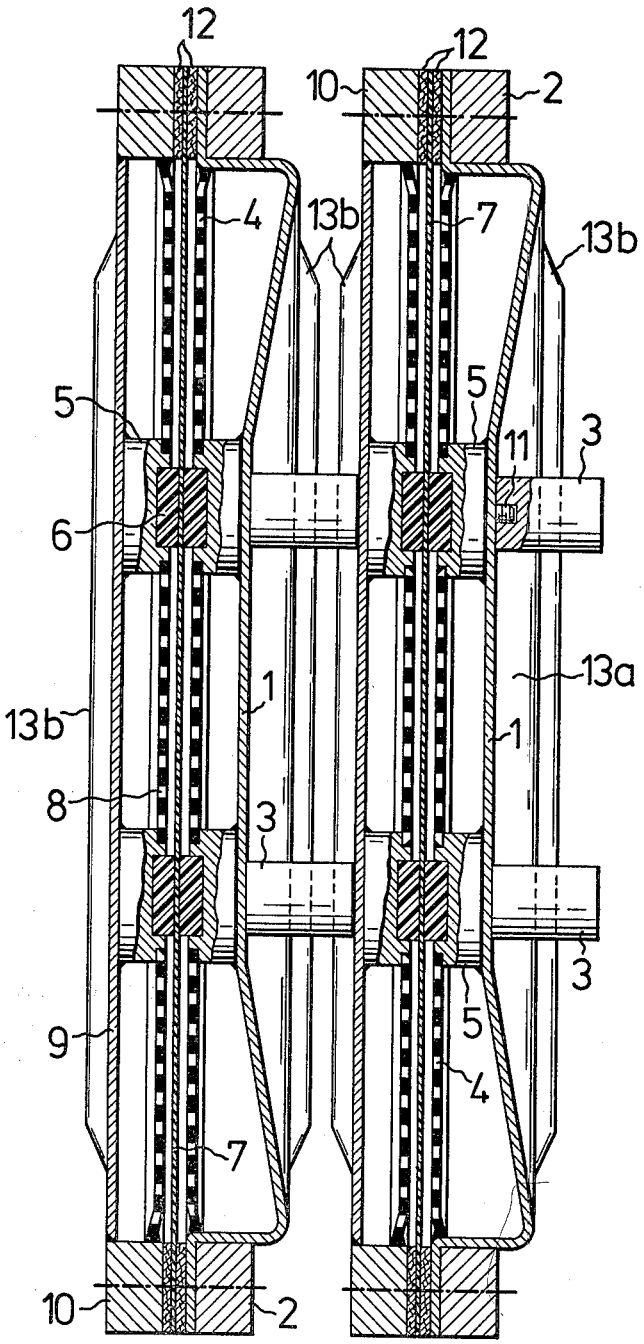

As demonstrated in FIG. 2, in the case of electrolysis apparatus comprising several electrolysis cells, anode and cathode of adjacent cells can be conductively connected with one another by means of power transmission elements 3 made from conductive material. The arrangement represents thus a bipolar electrolysis apparatus. Series-connection of such cells means high voltage and a relatively low current. On the other hand, series-connection has the advantage of better utilization of the capacity of the rectifier elements, of reduced copper consumption and less voltage losses in the contact bars. In certain cases, especially when using rectifiers already at hand having a relatively low voltage and high current intensity, it may be advantageous to use the bipolar elements in monopolar arrangement, that is, in parallel connection. Although the cells of the invention allow such a connection, it is advantageous to operate with simultaneous series and parallel connection. By correspondingly chosing a suitable size of series-connected groups of cells which are then parallel-connected, any intended amperage/voltage combination is possible.

Figure 7:
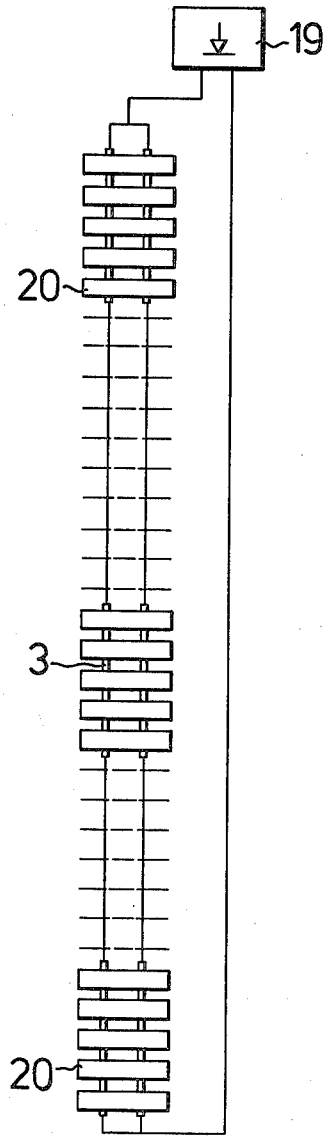
FIGS. 7 and 8 illustrate two embodiments of the electric wiring of the electrolysis cells of the invention.
Figure 8:
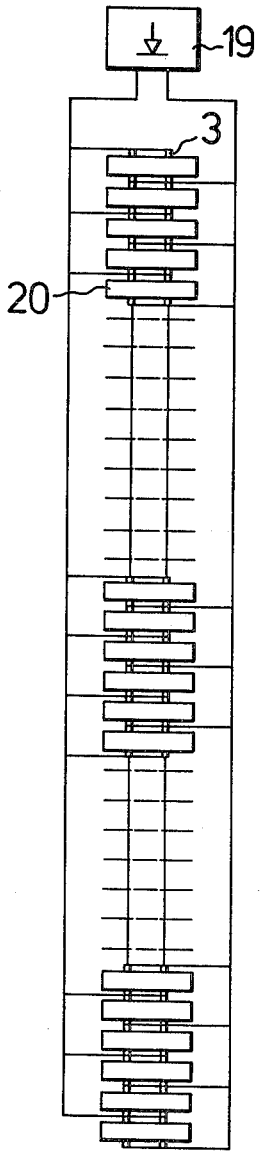

In order to demonstrate this, FIG. 7 shows the series-connection of 32 elements 20 of an electrolysis apparatus. At a voltage drop of 4 volts per element 20, the voltage at the rectifier 19 to 128 volts at a current of 8 kiloamperes. When on the other hand the elements 20 of the electrolysis apparatus are parallel-connected, as shown in FIG. 8, the voltage at the rectifier 19 is 4 volts when at identical current density as in the case of FIG. 7 the total current is 256 kiloamperes. Thus, it is perfectly clear to those skilled in the art how by variation of the number of elements per electrolysis apparatus and the number of such apparatus connected with one another, any current/voltage ratio intended is feasible.

What is claimed is:

1. In electrolysis apparatus for the manufacture of chlorine from an aqueous alkali metal halide solution, including at least one electrolytic cell having an anode, a cathode and a separating wall interposed between said anode and cathode; a housing formed of two shells for containing said anode, cathode and separating wall; means provided in said housing for feeding electrolysis starting materials therein and/or discharging the products of electrolysis therefrom; said shells having rims which, when the apparatus is assembled, clamp said separating wall therebetween; sealing elements positioned between said separating wall and the respective rims; and at least one pair of electrically non-conductive elements mechanically coupled to respective ones of said shells and having said separating wall disposed therebetween for establishing a spacing between said anode and cathode and a separation between said separating wall and each of said anode and cathode; the improvement wherein said anode and cathode both extend to the rims of said shells and are in mechanical and electrically conductive contact with respective ones of said rims; and electrically conductive spacer elements fixed to said shells and being in mechanical and electrical contact with respective ones of said anode and cathode.

2. Electrolysis apparatus as claimed in claim 1, wherein the shells of the electrolysis cells are provided with stiffenings.

3. Electrolysis apparatus as claimed in claim 1, wherein said means provided in said housing comprises at least one vertically positioned tube of non-conductive material penetrating near the rim into the interior of the shells for feeding starting materials for electrolysis and/or discharging products of electrolysis.

4. Electrolysis apparatus as claimed in claim 1, wherein said shells are hemispherical shells, at least one hemispherical shell of an electrolysis cell is provided on its outer face with conductive power transmission elements in extension of the electrically non-conductive elements and electrically conductive spacer elements.

5. Electrolysis apparatus as claimed in claim 1, wherein the cathodes are made from iron, cobalt, nickel or chromium or one of their alloys.

6. Electrolysis apparatus as claimed in claim 1, wherein the anodes are made from titanium, niobium, tantalum or an alloy of these metals, or of a metal-ceramic or oxide-ceramic material, and are coated with an electrically conductive, electrocatalytically active layer containing metals or compounds of the platinum metal group.

7. Electrolysis apparatus as claimed in claim 1, wherein the hemispherical shells on the side of the anode are made from a metal resistant to chlorine such as titanium, niobium, tantalum, or an alloy of these metals.

8. Electrolysis apparatus as claimed in claim 1, wherein the shells on the side of the cathode are made from iron, cobalt, nickel, chromium or one of their alloys.

9. Electrolysis apparatus as claimed in claim 1, wherein ion exchange membranes are used as separating walls.

* * * * *